United States Patent [19]

Cline et al.

[11] 4,345,231

[45] Aug. 17, 1982

[54] SUPPORT MEMBER

[75] Inventors: Joseph S. Cline; Cletus N. Andres, both of Highland, Ill.

[73] Assignee: Basler Electric Company, Highland, Ill.

[21] Appl. No.: 93,697

[22] Filed: Nov. 13, 1979

[51] Int. Cl.[3] ..... H01F 15/10

[52] U.S. Cl. ..... 336/192; 174/138 R; 174/175

[58] Field of Search ..... 174/175, 138 R, 92, 174/138; 24/81 CC; 336/192

[56] References Cited

U.S. PATENT DOCUMENTS

| | | | |
|---|---|---|---|
| 2,942,314 | 6/1960 | Debner et al. | 174/147 |
| 3,048,810 | 8/1962 | Steen | 174/92 X |
| 3,169,234 | 2/1965 | Renskers | 336/192 |
| 3,218,385 | 11/1965 | Potruch | 174/175 X |
| 3,391,432 | 7/1968 | Du Rocher | 174/175 |
| 3,407,264 | 10/1968 | Cull | 174/138 F |
| 3,609,616 | 9/1971 | Dumeige | 336/192 |

*Primary Examiner*—Thomas J. Kozma
*Attorney, Agent, or Firm*—Senniger, Powers, Leavitt and Roedel

[57] ABSTRACT

A member of relatively rigid insulating material for supporting a wire end of an electrical coil, for example, and an electrical connector thereon in fixed position relative to the coil, the connector being of the type having a shank secured to the wire end and a terminal portion extending beyond the wire end. A portion of the shank has, in transverse section, maximum first and second dimensions generally at right angles to one another, the second being smaller than the first. The support member has a recess therein extending therethrough, the recess being open at one end for reception of the wire end and open at the other end to enable the terminal portion of the connector to extend out of the recess. The member also has a slot therein extending axially of the recess from one end to the other for entry of the terminal into the recess. The slot has a width slightly greater than the second dimension of the shank of the connector but less than the first dimension, whereby the shank may be entered laterally through the slot into the recess and the connector and the member turned relative one to the other to a position in which the shank is prevented from moving laterally out through the slot.

10 Claims, 21 Drawing Figures

SUPPORT MEMBER

BACKGROUND OF THE INVENTION

This invention relates generally to electrical apparatus and more particularly to means for supporting a wire end and electrical connector secured thereto in fixed position.

This invention is especially applicable to electrical coils where it is important that the wire ends of the coil and the connectors secured thereto be held in fixed position relative to the coil to avoid bending of the wire adjacent the connector, which bending tends to cause breakage of the wire, whether the wire conductor is copper or aluminum. Termination supports heretofore employed have been relatively difficult to mount and have generally failed to prevent substantial bending of the wire ends and terminals.

SUMMARY OF THE INVENTION

Among the several objects of this invention may be noted the provision of an improved support member for supporting a wire end and an attached connector in fixed position relative to an object (e.g., an electrical coil) on which the member is mounted thereby to reduce bending of the wire adjacent the connector to avoid breakage of the wire thereat; the provision of such a means which is readily mountable in fixed position relative to an object such as an electrical coil; and the provision of such a means which is both reliable and durable and which is particularly useful as a termination support for freestanding electrical coils.

Generally, a support member of this invention is adapted for use with an electrical device, such as an electrical coil, having a wire end and an electrical connector on the wire end, the connector being of the type having a shank secured to the wire end and a terminal portion extending beyond the wire end. A portion of the shank of the connector as secured to the wire end has, in transverse section, maximum first and second dimensions generally at right angles to one another, the second being smaller than the first. The support member, which is of relatively rigid insulating material, supports the wire end and shank secured thereto in fixed position relative to the coil. The member has a recess therein extending therethrough, the recess being open at one end for reception of the wire end and at the other end to enable the terminal portion of the connector to extend out of the recess. The member has a slot therein extending axially of the recess from one end to the other, a portion of the slot having a width slightly greater than the aforesaid second dimension but less than the first dimension of the shank portion of the connector, whereby the shank portion may be entered laterally through the portion of the slot into the recess and the terminal and the member turned relative one to the other generally on the axis of the shank to a position in which the first dimension of the aforesaid shank portion extends generally widthwise of the slot thereby to prevent the shank from moving laterally out through the slot. A portion of the recess is of such cross section as to receive the aforesaid portion of the shank with a relatively snug fit when the connector is turned to said position. The member is formed to be mounted in fixed position relative to the coil, thereby to hold the connector and the wire end against bending of the wire adjacent the shank to avoid breakage of the wire thereat.

Other objects and features will be in part apparent and in part pointed out hereinafter.

BRIEF DESCRIPTION OF THE DRAWINGS

Corresponding reference characters indicate corresponding parts throughout the several views of the drawings.

DESCRIPTION OF PREFERRED EMBODIMENTS

Figure 1:
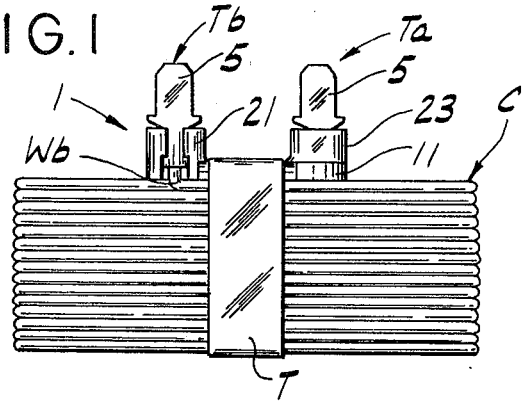
FIG. 1 is an elevation of a support member of this invention mounted on an electrical coil for supporting the coil wire ends and attached electrical connector in a fixed position relative to the coil.
Figure 2:
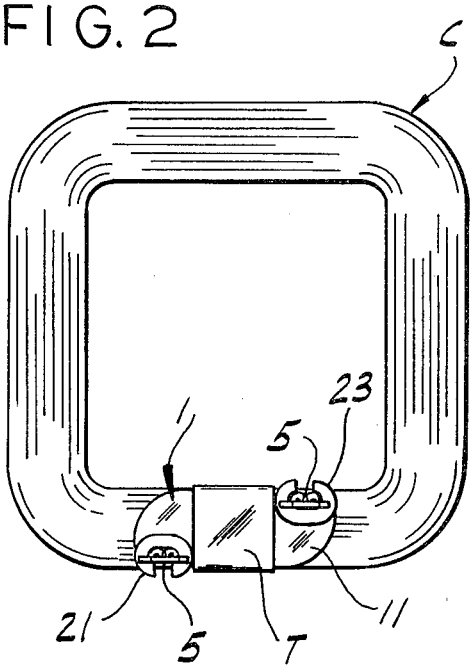
FIG. 2 is a plan of FIG. 1.

Referring now to FIGS. 1 and 2 of the drawings, a freestanding electrical coil C is shown as having a "start" wire end Wa, a "finish" wire end Wb and electrical connectors or terminal lugs Ta, Tb secured to the wire ends. A support member of this invention is designated generally by the reference numeral 1 and supports the wire ends and attached connectors in fixed position relative to the coil so as to avoid bending of the wire ends which weakens them and may cause them to break.

Figures 3, 4:
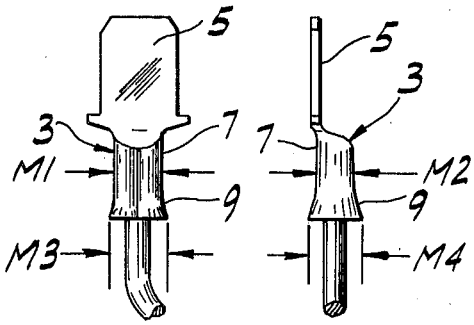
FIG. 3 is an enlarged front elevation of an electrical connector shown in FIG. 1.
FIG. 4 is an enlarged side elevation of the connector shown in FIG. 3.
Figure 5:
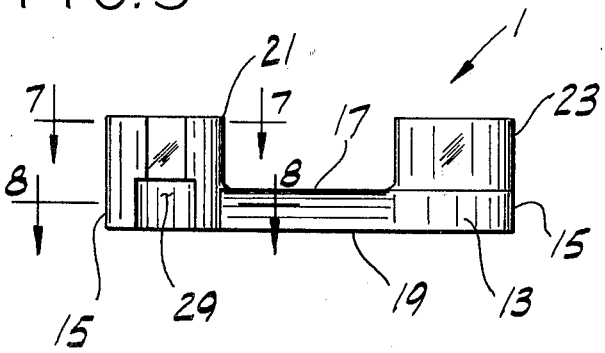
FIG. 5 is an enlarged elevation of the support member shown in FIG. 1.
Figure 7:
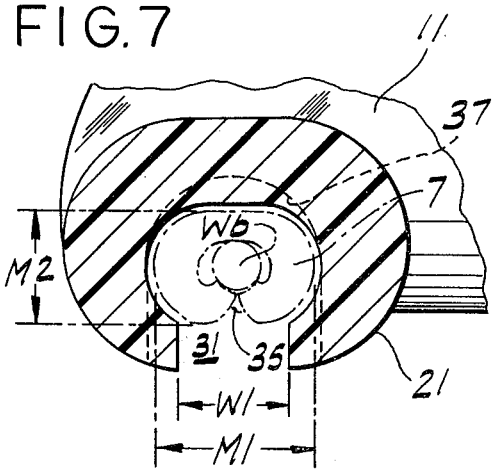
FIG. 7 is an enlarged horizontal section on line 7—7 of FIG. 5, a wire end and attached connector being shown in phantom.
Figure 8:
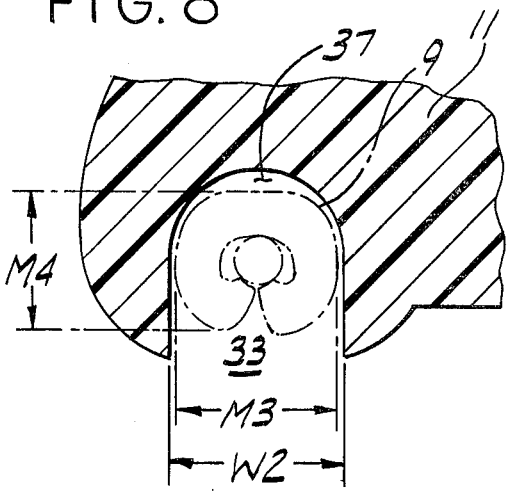
FIG. 8 is an enlarged horizontal section on line 8—8 of FIG. 5, a wire end and attached connector being shown in phantom.
Figure 9:
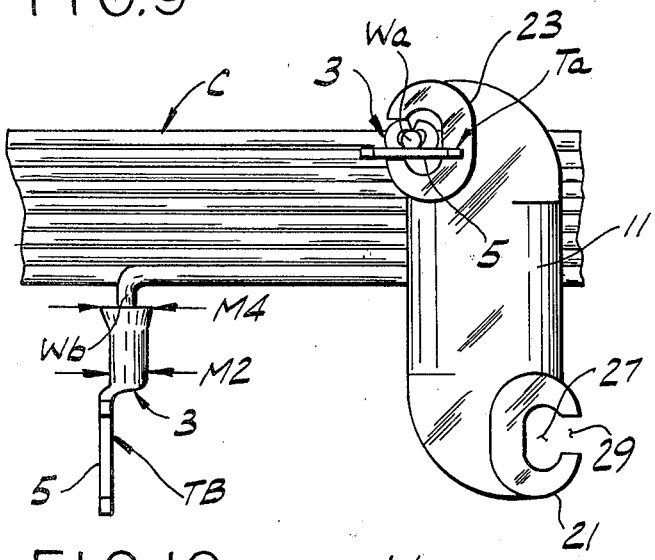
FIGS. 9–12 are plan views illustrating a preferred procedure for applying the support member of FIG. 1 to an electrical coil and the wire ends and electrical connectors secured thereto.
Figure 18:
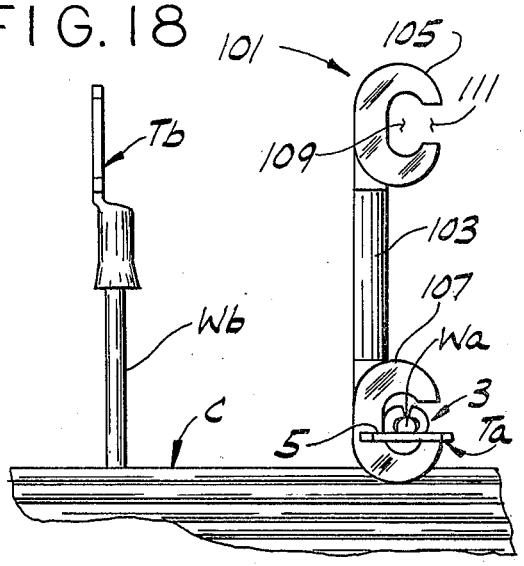
FIGS. 18–21 are elevational views illustrating a preferred procedure for applying the support member of FIG. 13 to an electrical coil and the wire ends and electrical connectors secured thereto.

Each connector Ta, Tb is of the type having a shank 3 secured (e.g., by crimping) to a respective wire end, and a terminal portion 5 extending beyond the wire end. While terminal portion 5 is shown to be a quick-disconnect (male) connector with a tab-type terminal, it will be understood that it may also be of any other configuration without departing from the scope of this invention. As crimped on its respective wire end, shank 3 comprises a first or upper portion 7 adjacent the terminal portion 5 of the connector and a second or lower portion 9. Portion 7 is deformed (i.e., flattened) as a result of the crimping operation and is generally oblong in transverse section (FIG. 7), having maximum first and second dimensions indicated at M1 and M2, respectively, generally at right angles to one another, the second dimension M2 being smaller than the first M1. The lower portion 9 is generally square in transverse section, having maximum first and second dimensions M3 and M4 generally at right angles to one another (FIGS. 4 and 8). Dimensions M3 and M4 are greater than dimensions M1 and M2.

The support member 1 is of a relatively rigid insulating material such as nylon, or any other suitable thermoplastic or thermosetting resin, and is formed for supporting both wire ends Wa, Wb and the connectors Ta, Tb thereon in a position in which they extend generally parallel to the axis of the coil (i.e., vertically). More particularly, the member 1 comprises a relatively flat rectangular base 11 having opposite sides 13, opposite ends 15, and a pair of opposing faces, one face (the top face as viewed in the drawing) being designated 17 and the other (bottom) face 19. The support member 1 also includes a pair of bosses projecting upwardly from the upper face 17 of the base. The first boss, designated 21, is at one side of the base and adjacent one end (the left end) of the base, and the other boss, designated 23, is at the opposite side of the base adjacent the opposite (right) end of the base. The diagonally-opposite corners of the base not occupied by the two bosses 21, 23 are rounded, as indicated at 25. The support member is mounted on the coil C by tape T with the bottom face 19 of the member held flat against the turns of the coil with the bosses 21, 23 extending generally axially of the coil. The tape T is lapped around the coil and base and extends between the bosses 21, 23. For reasons which will appear hereinafter, the width of the base preferably corresponds to the thickness or build of the coil C at one side of the coil.

Each boss 21, 23 is generally C-shaped as viewed from the top (see FIG. 6) and has a recess 27 therein extending axially through the boss and through the base. This recess 27 is open at one end (its lower end as viewed in the drawings) for reception of a respective wire end Wa, Wb, and at its other (upper) end to enable the terminal portion 5 to extend up out of the recess. The recess has a length not substantially greater than the length of the shank 3 of a respective connector Ta, Tb. A slot, indicated at 29, in the boss and in the base extends axially (vertically) of the recess from one end to the other, thereby providing access from a respective side of the member 1 into the recess 27. This slot 29 has upper and lower portions designated 31 and 33, respectively, the upper portion 31 of which has a width W1 (FIG. 7) slightly greater than the smaller maximum dimension M2 of the upper portion 7 of the shank for allowing the latter to be entered in the direction of its dimension M1 through the slot. However, the width of the upper portion 31 of the slot is less than the larger maximum dimension M1 so that when turned to the position shown in phantom in FIG. 7, the shank 3 is prevented from moving laterally out through the slot. The lower portion 33 of the slot is wider than the upper portion 31 and has a width W2 greater than dimensions M3 and M4 of the lower shank portion 9 of the connector for allowing the latter to be entered through the slot into the recess (FIG. 8).

It will be understood that slot 29 could have a uniform width if shank 3 were crimped along its entire length to have a generally uniform oblong cross section with maximum dimensions M1 and M2. However, it is somewhat preferable that the lower portion 33 of the slot be wider than the upper portion 31 so as to be able to accommodate a larger lower shank portion.

The recess 27 has an upper portion 35 laterally adjacent the upper portion 31 of slot 29 and a lower portion 37 laterally adjacent the lower portion 33 of the slot. As shown in FIG. 7, the upper portion is generally elliptical in shape and sized for relatively snug fit therein of the upper shank section 7 of a terminal when the latter is oriented in the recess with its dimension M1 extending widthwise of the slot 29. The lower portion 37 of the recess is sized to receive therein the lower portion 9 of the connector shank (FIG. 8). As with slot 29, the lower portion of recess 27 could be identical in transverse section to the upper portion 35 if the shank 3 were crimped along its entire length to have a uniform oblong section.

Figure 6:
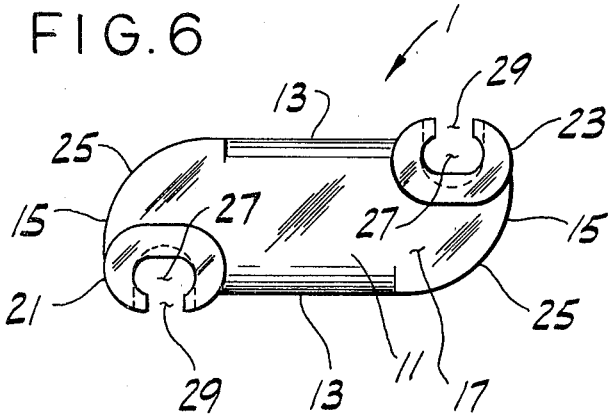
FIG. 6 is an enlarged plan of the support member of FIG. 5.

The central axes of the recesses through the bosses 21, 23 are generally parallel, and, as shown in FIG. 6, the slots 29 in the bosses open laterally outwardly away from the base 11 in opposite directions.

FIGS. 9–12 illustrate a preferred procedure by which the terminal support 1 of this invention is quickly and easily applied to coil C. With wire end Wa (e.g., the "start" lead of the winding) and attached connector Ta extending axially of the coil (toward the viewer as seen in the drawings) and terminal portion 5 of connector Ta generally parallel to the turns of the wire therebelow, and with wire end Wb and connector Tb extending radially of the coil into its window and with Tb's terminal portion 5 in a generally vertical plane, support member 1 is moved to the position shown in FIG. 9, with the upper and lower portions 7, 9 of shank 3 of connector Ta entering laterally in the direction of dimensions M1 and M3 through the upper and lower portions 31, 33 of slot 29 and into recess 27 of boss 23. The support member is then turned approximately 90° in a clockwise direction to the position shown in FIG. 10, the connector Ta thereby assuming a position in recess 27 wherein dimensions M1, M3 of the shank portions 7, 9 extend generally widthwise of the slot 29. Thus, shank 3 of connector Ta is held snugly in the recess and is prevented from moving laterally out through the slot.

Figure 10:
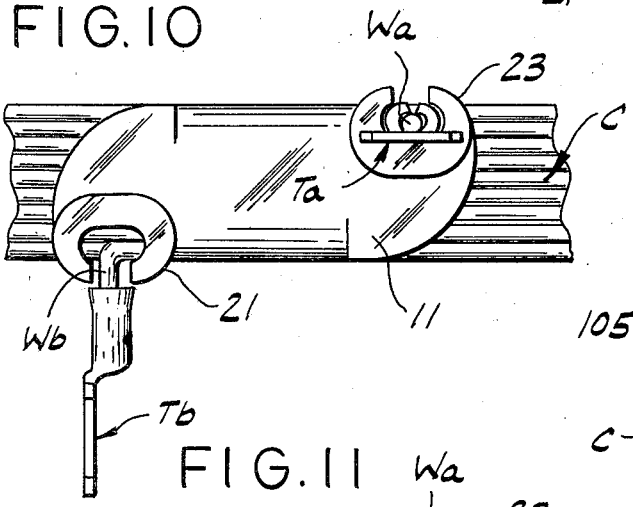
Figure 12:
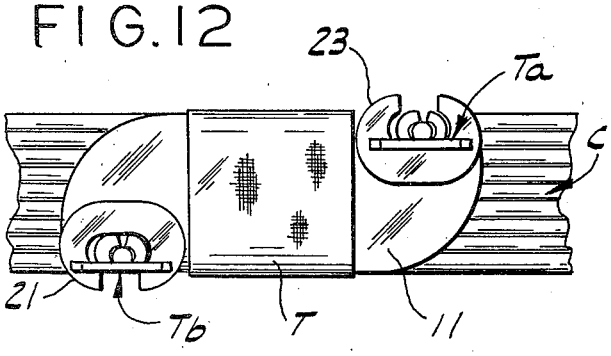

In the FIG. 10 position, the recess 27 of the left boss 21 and base 11 is in position for receiving wire end Wb (e.g., the "finish" lead or end of the winding) and attached connector Tb. To accomplish this, wire end Wb and connector Tb are swung up and entered through slot 29 and into recess 27 in boss 21 (see FIG. 11). Connector Tb is then twisted approximately 90° about its axis so that the dimensions M1 and M3 of the shank portions 7, 9 of the terminal Tb extends generally widthwise of the slot 29 (FIG. 12). In this position, connector Tb is held snugly in recess 27 and prevented from moving laterally out through the slot 29. It will be observed that the construction of the base 11 to have a width approximately equal to that of the build of coil C is advantageous in that the recesses 27 are properly positioned to receive the wire ends Wa, Wb and attached connectors Ta, Tb as they extend vertically up on the sides of the coil.

As the final step in the procedure for applying support member 1 to coil C, the base 11 is secured in place on the coil with tape T which is lapped around the turns of the coil and the base between the bosses 21, 23 on the base (FIG. 12). Other means for mounting the support member on the coil are also suitable.

It will be understood that while the procedure described above for applying the support member to the coil is preferable in that it minimizes bending and twisting of the wire ends, other procedures may also be used.

It will be apparent from the foregoing that with connectors Ta, Tb and wire ends Wa, Wb in recesses 27, and with the support member secured to the coil, bending of the wire adjacent (below) the shank portion 3 of each terminal is substantially prevented, thereby avoiding breakage of the wire which might otherwise result if it were unsupported and free to bend back and forth. While the support member is shown as being secured directly on the coil, it will be understood that it may also be used to support the coil wire ends Wa, Wb and connectors Ta, Tb thereon in fixed position relative to the coil at a location spaced from the coil.

Referring now to FIGS. 13–17, an alternate support member of this invention is designated generally 101 and is formed for supporting wire ends Wa, Wb and connectors Ta, Tb thereon in a position in which the wire ends and attached connectors extend generally radially of the coil (rather than axially). This member, which is also of a rigid insulating material such as nylon, comprises a relatively flat base 103 having a width generally corresponding to the build of coil C, and a pair of socket members formed integrally with the base and extending laterally from the base at one side thereof. The left socket member (as viewed in FIGS. 13–15) is designated 105 and the right socket member 107. These socket members are generally C-shaped in section and each has a recess 109 and slot 111 therein substantially identical to the recess 27 and slot 29 previously described in regard to support member 1. Thus the recess 109 comprises first and second portions designated 113 and 115 corresponding in size and shape to portions 35 and 37, respectively, of recess 27. The first or outer portion 113 is generally elliptical in section and sized for a relatively snug fit therein of shank portion 7 of a connector when the latter is oriented in the recess with its larger maximum dimension M1 extending widthwise of the slot 111, and the second or inner portion 115 is sized to receive therein shank portion 9 of the connector. The axes of the two recesses 109 through the socket members 105, 107 are generally parallel. Slot 111 extends axially of the recess 109 from one end of the socket member to the other and has a first relatively narrow portion 117 having a width W1′ corresponding to the width W1 of slot 29 and a second wider portion 119 having a width W2′ corresponding to the width W2 of slot 29.

As indicated at 121, the base is slotted for receiving therein wire end Wa as it extends from a position inside the coil C into the right socket member 107. The finish wire end Wb is received in a second slot 123 in the base.

FIGS. 18–21 illustrate the preferred procedure for readily applying terminal support 101 to coil C. With wire end Wa extending radially of the coil and the terminal portion 5 of the connector Ta extending in a generally horizontal plane, and with wire end Wb extending axially of the coil and the terminal portion 5 of connector Tb extending in a plane generally perpendicular to the turns of the coil therebelow, the support member 101 is moved to the position shown in FIG. 18, with portions 7, 9 of shank 3 of connector Ta entering laterally in the direction of dimensions M1 and M3 through the first and second portions 117, 119 of slot 111 and into the recess 109 in socket member 107. The support member 101 is then swung down to the position shown in FIG. 19 wherein the base 103 rests flat on the turns of the coil and wherein the connector Ta assumes a position in the socket member 107 in which the maximum dimensions M1, M3 of shank portions 7, 9 extend generally widthwise of the slot 111. Thus shank portion 7 of the terminal Ta is held snugly in the recess and prevented from moving laterally (up) out through the slot.

Figure 19:
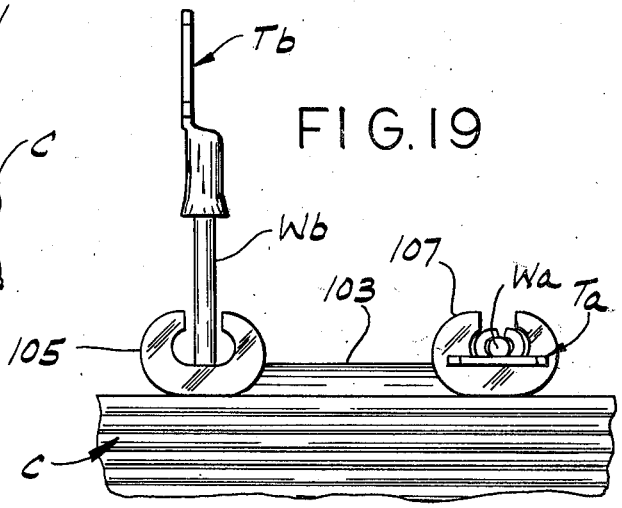
Figure 11:
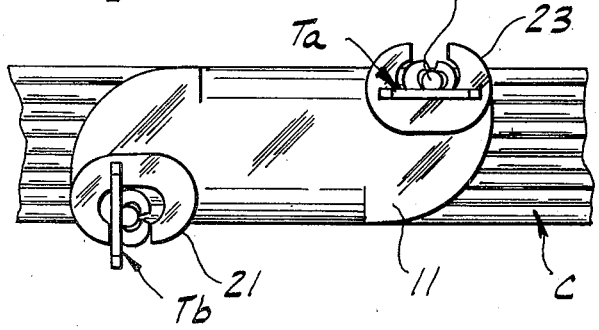
Figure 20:
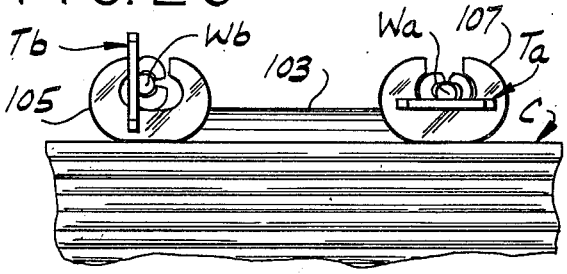
Figure 21:
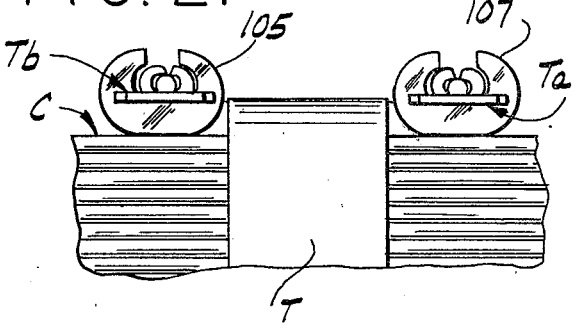
Figure 13:
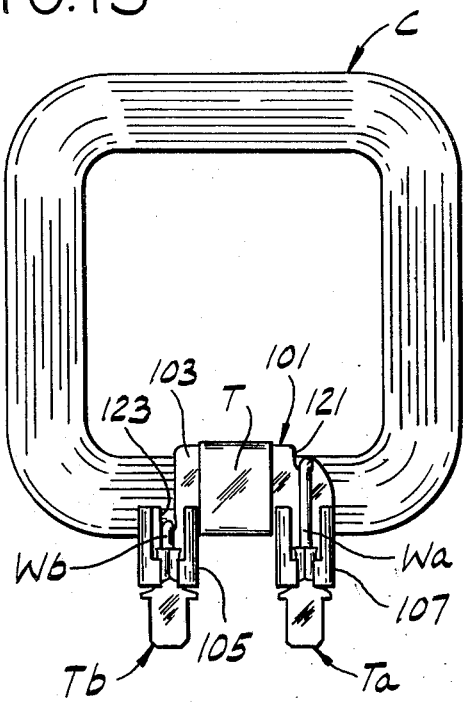
FIG. 13 is a plan of a second support member of this invention mounted on an electrical coil.
Figure 14:
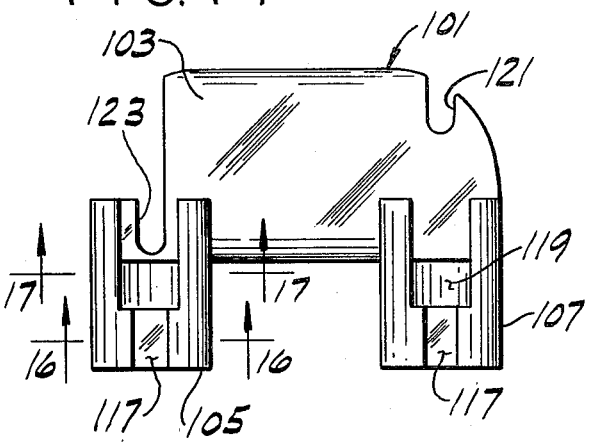
FIG. 14 is an enlarged plan of the support member shown in FIG. 13.
Figure 15:
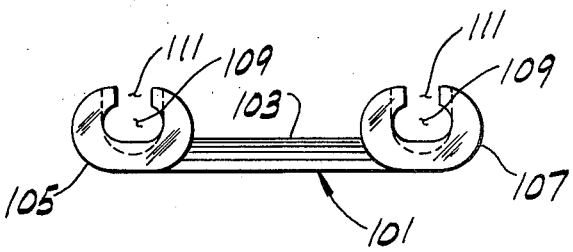
FIG. 15 is an elevation of FIG. 14.
Figure 16:
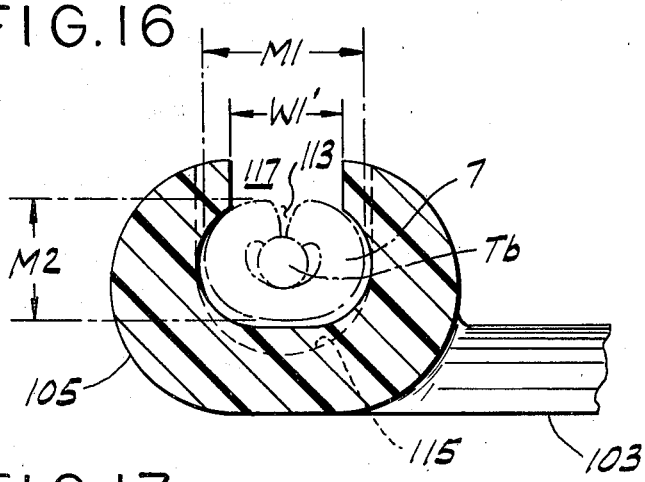
FIG. 16 is an enlarged vertical section on line 16—16 of FIG. 14, a wire end and attached connector being shown in phantom.
Figure 17:
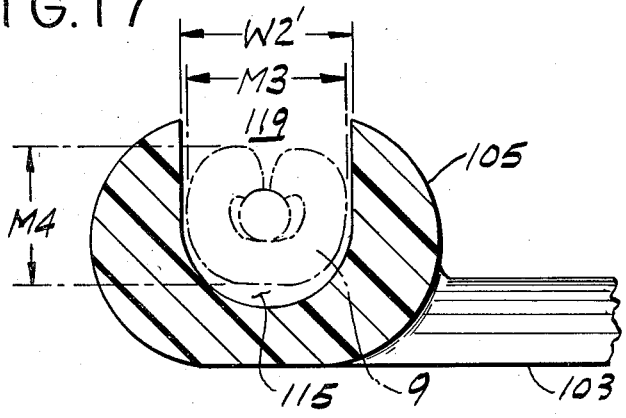
FIG. 17 is an enlarged vertical section on line 17—17 of FIG. 10, a wire end and attached connector being shown in phantom.

In the FIG. 19 position, the left socket member 105 is in a position for receiving wire end Wb and connector Tb. This is accomplished by bending the coil end down and entering it and the connector Tb through the slot 111 into the recess 109 in the socket member 105 (FIG. 20). The connector is then twisted approximately 90° about its axis so that the maximum dimensions M1 and M3 of the shank portions 7, 9 extend generally widthwise of the slot 111 (FIG. 21). In this position connector Tb is held snugly in the recess and prevented from moving back through the slot. The support member 101 is then secured in place on the coil C, as by wrapping tape T around the coil and the base 103 between the socket members 105, 107.

The procedure described above for applying the support member 101 to coil C is preferred in that it minimizes bending and twisting of the wire ends Wa, Wb, but it will be understood that the procedure may be varied. It will also be understood that the support member 101 may be mounted at locations other than directly on the coil for supporting the wire ends Wa, Wb and attached connectors Ta, Tb at locations spaced from the coil. Further it is to be understood that the support members of this invention are useful whether the coil is used or sold as such or assembled with a core in a transformer, relay, choke or solenoid device, etc.

While support members 1 and 101 are described herein as supporting the wire ends Wa, Wb of a free-standing coil and the connectors Ta, Tb thereon, it will be recognized that the support members may be used for supporting any free wire ends or leads having connectors Ta, Tb attached thereto, and that the wire ends need not be coil wire ends.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. In combination with an electrical device having a wire end and an electrical connector on the wire end, the connector having a shank secured to the wire end and a terminal portion extending beyond the wire end, a portion of said shank as secured to the wire end having, in transverse section, maximum first and second dimensions generally at right angles to one another, the second being smaller than the first, a member of relatively rigid insulating material supporting the wire end and shank secured thereto in fixed position relative to the electrical device, said member having a recess therein extending therethrough, said recess being open at one end and receiving the wire end and being open at the other end to enable the terminal portion of the connector to extend out of the recess, said member having a slot therein extending axially of the recess from one end to the other, a portion of said slot having a width slightly greater than said second dimension but less than said first dimension, whereby said portion of the shank is entered laterally through said portion of the slot into the recess and said connector and said member turned relative one to the other generally on the axis of the shank to a position in which said first dimension extends generally widthwise of the slot thereby to prevent the shank from moving laterally out through the slot, a portion of the recess being of such cross section as to receive said portion of the shank with a relatively snug fit when the connector is turned to said position, and said member being mounted in fixed position relative to said electrical device, thereby holding the connector and the wire end against bending of the wire adjacent the shank to avoid breakage of the wire thereat.

2. A combination as set forth in claim 1 wherein said portion of the slot is laterally adjacent said portion of the recess.

3. A combination as set forth in claim 1 wherein said portion of the recess and said portion of the slot are adjacent said other end of the recess.

4. A combination as set forth in claim 1 wherein the slot has a second portion having a width greater than that of the first portion for enabling passage through the slot of a portion of the shank larger in transverse section than said second dimension.

5. A combination as set forth in claim 4 wherein the second portion of the slot is adjacent said one end of the recess.

6. A combination as set forth in claim 1 wherein said member comprises a base having a boss thereon, said recess extending axially through the boss and the base.

7. A combination as set forth in claim 6 wherein said other end of the recess is at the outer end of the boss and said portion of the recess and said portion of the slot are in the boss.

8. For use with an electrical device, such as an electrical coil, having a wire end and an electrical connector on the wire end, the connector having a shank secured to the wire end and a terminal portion extending beyond the wire end, a portion of said shank as secured to the wire end having, in transverse section, maximum first and second dimensions generally at right angles to one another, the second being smaller than the first, a member of relatively rigid insulating material for supporting the wire end and shank secured thereto in fixed position relative to the coil, said member having a recess therein extending therethrough, said recess being open at one end for reception of the wire end and at the other end to enable the terminal portion of the connector to extend out of the recess, said member having a slot therein extending axially of the recess from one end to the other, a portion of said slot having a width slightly greater than said second dimension but less than said first dimension, whereby said portion of the shank may be entered laterally through said portion of the slot into the recess and said connector and said member turned relative one to the other generally on the axis of the shank to a position in which said first dimension extends generally widthwise of the slot thereby to prevent the shank from moving laterally out through the slot, a portion of the recess being oblong in cross section and dimensioned to receive said portion of the shank with a relatively snug fit when the connector is turned to said position, and said member being formed to be mounted in fixed position relative to the coil, thereby to hold the connector and the wire end against bending of the wire adjacent the shank to avoid breakage of the wire thereat, said member being formed for supporting a pair of wire ends and electrical connectors secured thereto in fixed position relative to said coil, said member comprising a generally rectangular base having opposite sides, opposite ends and a pair of opposing faces, and a pair of bosses projecting from one face of the base at opposite sides and adjacent opposite ends thereof, each boss having an aforesaid recess and slot therein with the axes of the recesses through the bosses being generally parallel, and with the slots in the bosses opening laterally outwardly away from the base in opposite directions.

9. A combination as set forth in claim 1 wherein said member comprises a base and a socket member extending from the base, said recess extending axially through the socket member.

10. A combination as set forth in claim 9 formed for supporting a pair of wire ends with connectors secured thereto in fixed position relative to said electrical device, said base having a pair of socket members thereon extending from the base at one side of the base, each socket member having an aforesaid recess and slot therein, the axes of said recesses through the socket members being generally parallel.

* * * * *